United States Patent [19]

Miller

[11] Patent Number: 4,919,418

[45] Date of Patent: Apr. 24, 1990

[54] COMPUTERIZED DRIVE MECHANISM FOR EXERCISE, PHYSICAL THERAPY AND REHABILITATION

[76] Inventor: Jan W. Miller, 725 N. Hite Ave., Louisville, Ky. 40206

[21] Appl. No.: 342,015

[22] Filed: Apr. 24, 1989

Related U.S. Application Data

[63] Continuation-in-part of Ser. No. 148,881, Jan. 27, 1988, abandoned.

[51] Int. Cl.[5] ..... A63B 21/24

[52] U.S. Cl. ..... 272/129; 272/125; 272/130; 272/DIG. 5; 73/329

[58] Field of Search ..... 272/129, 130, DIG. 4, 272/DIG. 5, 125; 73/379, 380, 381

[56] References Cited

U.S. PATENT DOCUMENTS

| | | | |
|---|---|---|---|
| 4,326,707 | 4/1982 | Strecker | 272/130 |
| 4,609,190 | 9/1986 | Brentham | 272/130 |
| 4,674,741 | 6/1987 | Pasierb, Jr. et al. | 272/132 X |
| 4,705,271 | 11/1987 | Mondloch et al. | 272/130 |
| 4,726,583 | 7/1988 | Olsen et al. | 272/130 |

*Primary Examiner*—Richard J. Apley
*Assistant Examiner*—Joe H. Cheng
*Attorney, Agent, or Firm*—Charles J. Prescott; Raymond H. Quist

[57] ABSTRACT

Exercise equipment having a reciprocating extendible and retractible tension transmitting device is equipped with a control which restricts the extension to a constant velocity and impose a compulsory constant velocity retraction. The control may be hydraulic or electrical and may be a linear actuator. Transducers, and/or a load cell connected to the apparatus produce signals representing the performance of the user. These signals are processed by a control computer which produces control signals. The computer may also produce signals representing the user's previous performance for display and storage. The display may be an audiovisual display presenting animated graphics representing the user's present exercise performance as compared with the user's previous performance. The display also provides incentive, reinforcement, and motivation based upon the utilization of the comparative performance data. A sound generation system generates encouraging spoken remarks and provides background music.

18 Claims, 4 Drawing Sheets

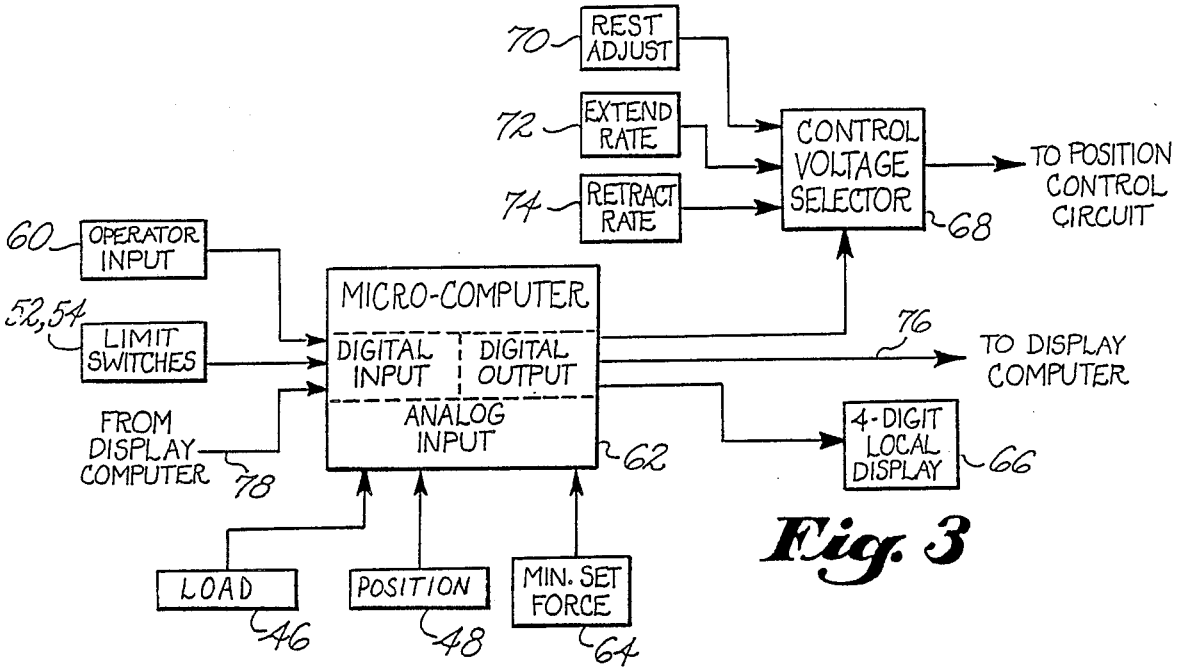
Fig. 3
Fig. 4
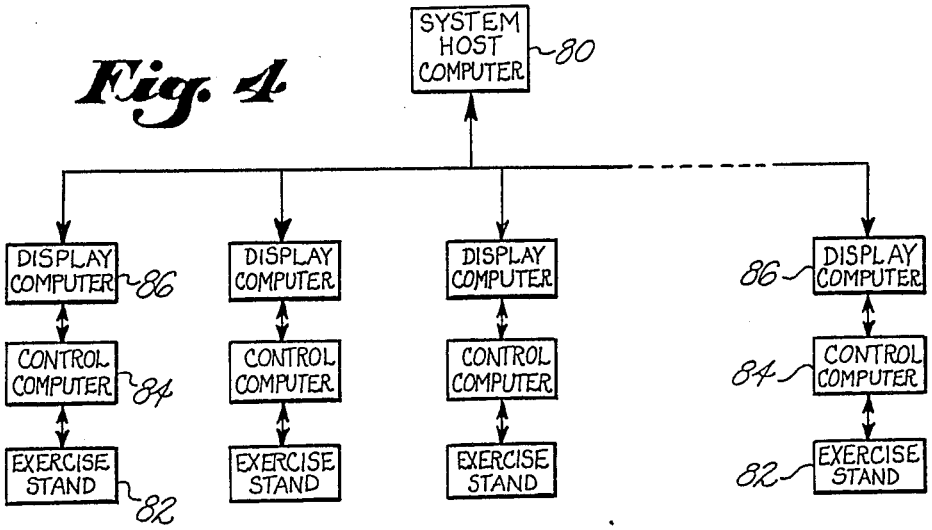
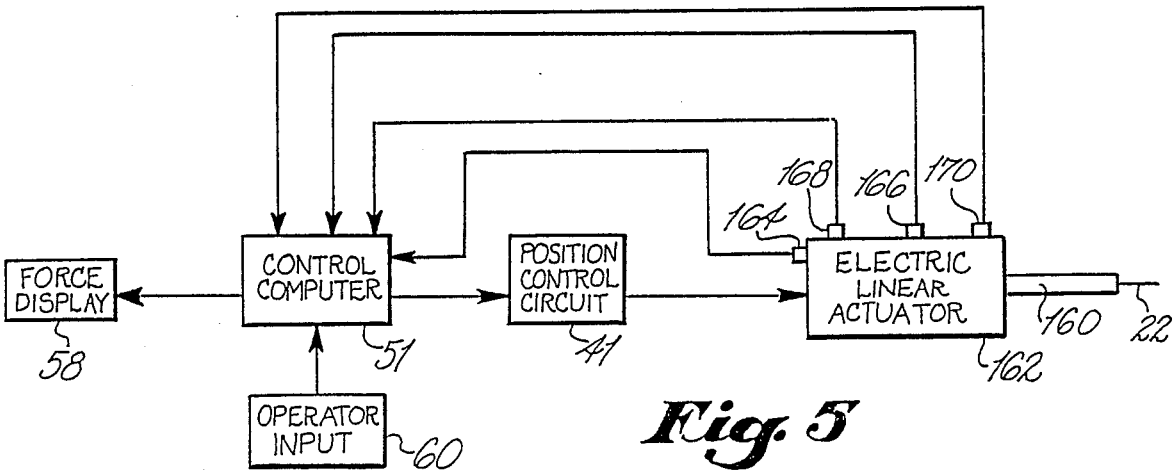
Fig. 5

COMPUTERIZED DRIVE MECHANISM FOR EXERCISE, PHYSICAL THERAPY AND REHABILITATION

This application is a continuation-in-part of application Ser. No. 07/148,881, filed Jan. 27, 1988, now abandoned.

BACKGROUND OF THE INVENTION

1. Field of the Invention

This invention relates generally to exercise apparatus, and more particularly to exercise apparatus for enforcing the proper use of such apparatus and to provide motivation for using the apparatus.

2. Description of Related Art

The use of free weights to build strength has been supplemented by various machines which permit exercise of isolated muscles or groups of muscles. Machines of this type restrict the movement of the part of the body being exercised to a defined path while the remainder of the body is relatively immobile. Such machines may involve the lifting of a weight through a system of levers and pulleys, and then lowering the weight. Machines of this type are sold under the trademarks "UNIVERSAL" and "NAUTILUS".

A major deficiency of these machines is that the velocity at which the weight is moved is controlled by the user. Many, if not most, users will move the weight at a velocity which is too fast for optimum muscle development.

Another problem is that the weight which is lowered is the same as the weight which is lifted, even though the muscles are capable of controlled lowering of a larger weight than they can lift. This controlled lowering of a weight, or negative resistance, is the most beneficial exercise for developing strength.

It is also desirable to perform a number of repetitions of each exercise, such as eight to twelve, so as to fatigue the muscle(s) being exercised. Because the capability of the muscles to perform the exercise decreases with each repetition, a weight which is less than the maximum which can be lifted is usually selected for the exercise. A preferred form is to have the weight for each repetition to be the maximum for that repetition; i.e. the weight should change with each repetition.

The weights used on these machines are in stacks with each weight being ten or twenty pounds. Unless one resorts to manually placing an additional smaller weight on the stack, a long period of time may pass until one can move up to the next highest weight. Although one is making progress during this time by being able to more readily complete the minimum repetitions or by adding repetitions, this extended time can be demoralizing. Even when one does reach the point of adding an additional weight, he is starting over with the minimum acceptable number of repetitions—eight. This may have a negative impact on the exerciser's motivation.

In spite of the foregoing deficiencies of these machines, they have been widely used and have improved the strength and conditioning of countless people.

A number of devices have been patented which provide additional capabilities to those of the machines referred to above. U.S. Pat. No. 4,235,437, Ruis et al, entitled "Robotic Exercise Machine and Method", discloses a hydraulic driven and controlled apparatus which can be programed to provide a number of different exercise paths for a user. These paths must be programmed for each new user by a trained technician. The device lacks the simplicity necessary for use in a health club or spa type environment. It also cannot be readily retrofitted on stacked weight type machines. Moreover, two separately controlled, hydraulically driven links are required for its operation.

U.S. Pat. No. 4,257,593, Keiser, entitled "Pneumatic Exercising Device", discloses a device which requires a compressed air supply. During the positive movement of the exercise handles the force required steadily increases, this maximum force must be resisted as the negative movement begins In addition, this apparatus fails to provide isokinetic control. The disclosed structure also does not provide for retrofitting on stacked weight type machines.

U.S. Pat. No. 4,544,154, Ariel, entitled "Passive Programmable Resistance Device", discloses a passive programmable resistance device which uses a closed loop feedback to control the resistance to be overcome. A computer is provided to store data pertaining to a user's performance for future analysis. Operation of the equipment is fairly complicated, militating against its use by the average person. Moreover, this apparatus does not provide isokinetic eccentric exercise, nor is it adapted to be readily applied to existing stacked weight machines.

U.S. Pat. No. 4,628,910, Krukowski, entitled "Muscle Exercise and Rehabilitation Apparatus", discloses apparatus for the application of constant resistive torque and/or constant velocity in both concentric and eccentric movement. A trained technician is necessary for the operation of this device. This apparatus is not adapted to be readily applied to existing stacked weight machines.

Devices have also been patented which couple an exercise cycle with a display and/or programmed varying resistance. U.S. Pat. No. 4,358,158, Sweeney, Jr., entitled "Programmed Exerciser Apparatus", provides for programming by the user for variation in the resistance exerted by the device.

U.S. Pat. No. 4,408,613, Relyea, entitled "Interactive Exercise Device", discloses apparatus which couples a varying resistance with a video monitor displaying an exercise program or race.

U.S. Pat. No. 4,542,897, Melton et al, entitled "Exercise Cycle with Interactive Amusement Device", provides a video game display.

DEFINITIONS

Isokinetic—exercise where the speed of exercise motion is held constant during a dynamic contraction, so that external resistive force varies in response to magnitude of muscular force.

Concentric—exercise where there is movement in the direction force is applied. (For example when a bar bell is lifted from the floor.)

Eccentric—exercise where there is movement in the direction opposite to the direction of the force applied. (For example when a bar bell is lowered to the floor.)

Compulsory Isokinetic Eccentric—isokinetic (constant velocity) movement regardless of resisting force imposed by the user.

Although isokinetic operation in both the concentric and eccentric modes is necessary for the optimum development of strength, most of the apparatus referred to above does not provide this feature. Those devices which do provide this capability require a trained technician to operate them and interpret the results. In addition, while some devices provide a prescribed program of exercises to follow or provide a record of the number of repetitions performed and the resistance employed, none of these devices utilize a real time comparison of previous performance with present performance as a means of motivation. This instantaneous feedback of improvement based upon previous performance provides a continuous challenge to try harder.

SUMMARY OF THE INVENTION

The invention is a reciprocating control system which limits the movement of an exercise machine handle to a relatively slow, constant velocity during extension and retraction. The control system also provides a resisting force during extension sufficient to counteract any force imposed by the user. During retraction the control similarly exerts a force sufficient to cause the isokinetic movement regardless of the resisting force imposed by the user. The force exerted by the user is continuously measured, and is preferably displayed contemporaneously. The control system may be incorporated in a supporting structure which supports the exercise machine handle by a tension transmitting device such as a cable or chain. The control system may also be applied as a retrofit device to existing exercise machines of the stacked weight type. A computer system is used to direct the application of the control system and to calculate the force being applied by the user. The force applied during each repetition of extension and retraction may be recorded and displayed on the next occasion when the user exercises at the machine to provide a real time motivational comparison between the previous exercise repetitions and the present.

It is therefore an object of this invention to provide apparatus for the performance of isokinetic exercise reciprocating between the concentric and compulsory isokinetic eccentric modes.

It is also an object of this invention to provide apparatus which will completely fatigue the muscle(s) being exercised.

It is a further object of this invention to provide apparatus which may be readily installed on existing stacked weight machines.

It is an important object of this invention to provide an instantaneous comparison of an individual's present exercise performance with the performance on the previous occasion.

In accordance with these and other objects, which will become apparent hereafter, the instant invention will now be described with reference to the accompanying drawings.

BRIEF DESCRIPTION OF THE DRAWINGS

FIG. 3 is a block diagram showing the control computer of FIG. 2 in more detail;

FIG. 4 is a block diagram showing the applicability of the invention to multiple exercise stands;

FIG. 5 is another embodiment of a movement control system in accordance with the invention;

DETAILED DESCRIPTION OF THE INVENTION

Figure 1:
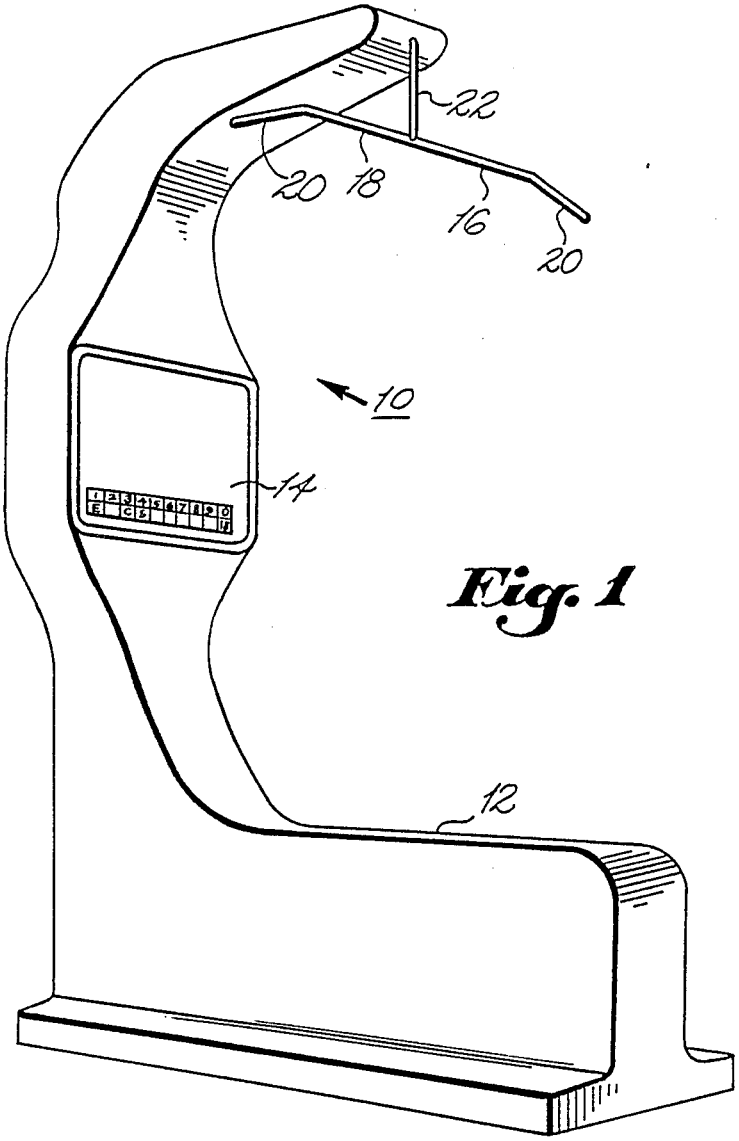
FIG. 1 is a perspective view of an overhead pull down machine in accordance with the invention.

Referring to FIG. 1, an overhead pulldown machine is depicted having a supporting structure generally indicated at 10. Supporting structure 10 provides an operator support 12, a visual display 14 and an operator force application device 16. Operator force application device 16, in this embodiment, is a laterally extending bar 18 having grips 20 at each end. The overhead pulldown machine is used to exercise a particular group of muscles. It will be recognized that other machines may be used to exercise other muscles or groups of muscles. All such machines include, as a minimum, some type of supporting structure and some type of operator force application device. Most machines also have some type of operator support. A common feature to these machines is a cable or other flexible tension transmitting device through which the user exerts force. The present invention may be beneficially employed in all of these types of machines.

In use, an operator will sit astride platform 12, facing visual display 14, grasp grips 20 and pull bar 18 down. Bar 18 is connected to cable 22 which will extend further from support structure 10 in response to the force exerted by the operator. As will be described later, this force must exceed a minimum amount. In addition, this machine permits only isokinetic movement both concentrically and compulsively eccentrically. During the concentric movement, as the muscles contract, the handles cannot be moved faster than the velocity which has been fixed (This velocity in the embodiment built can be fixed any where between 0.25 and 15 inches per second). Also, if the operator pauses or fails to continue to exert force, cable 22 will automatically begin to retract at a fixed rate. Thus, the distance through which the bar 18 is moved can be varied by the operator up to a maximum distance. During the compulsive isokinetic eccentric movement, as the muscles gradually extend, the bar moves upward isokinetically no matter how much force the operator exerts. It will be recalled that an operator can exert a greater force during eccentric movement than during concentric movement. The machine automatically permits this application of greater force.

Visual display 14 provides to the operator a presentation which shows that operator's performance on that machine during the operator's previous set of exercise repetitions, and also shows the operator's present performance as it occurs by comparison. The force will typically vary from the beginning of a cycle of concentric movement to the end of this cycle. The force displayed will also vary and the force displayed for the previous set will also be presented for the same times in the concentric cycle. The operater therefore has an instantaneous feedback on present performance versus past. The display may be side by side bar graphs or the display may show two cars racing with one car moving at speeds representative of the forces exerted during a previous performance, and the other car moving at a speed depicting the forces being exerted during the present exercise. This comparative visual display thereby provides motivation to the operator to try to improve his present performance over his past performance. The keyboard at the bottom of display 14 permits the operator to enter an identification number or other information.

Fundamentally, the exercise apparatus of the present invention involves the control of the movement of a cable (such as cable 22 of FIG. 1) or of another tension transmitting device as it is extended from an original position or origin to an extended position, and also as it is retracted to the origin. Numerous conventional exercise machines of different types include a cable or the like, but control of the velocity of the cable is supplied by the user. Such conventional machines typically have a stack of weights, some or all of which are lifted by the application of tension to the cable when the user applies force to the force application device. Consequently, the present invention may be considered apparatus to control the positioning during a time interval of an extendable and retractable tension transmitting device. This control produces isokinetic movement both during the concentric stage (extension of the cable) and eccentric stage (retraction of the cable).

Figure 2:
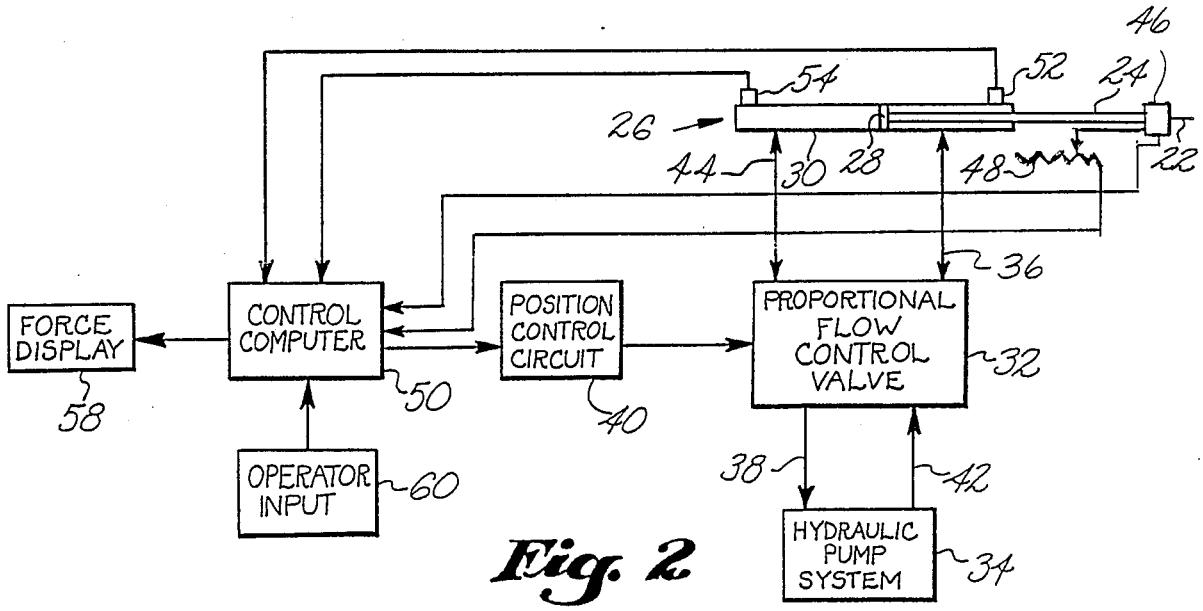
FIG. 2 is a block diagram of a movement control system in accordance with the invention.

Referring to FIG. 2, cable 22 of FIG. 1 is shown connected to load cell 46 at the end of piston rod 24 of linear actuator 26. Piston rod 24 is secured to piston 28 which is mounted within hydraulic cylinder 30 of linear actuator 26. Hydraulic fluid is contained within cylinder 30 on both sides of piston 28. As tension is applied to cable 22, a force is applied through piston rod 24 to piston 28. This force is resisted by the pressure of the hydraulic fluid on the face of piston 28 on the piston rod side of the cylinder and also by the friction of the system. The tension force is aided by the pressure of the hydraulic fluid on the other side of piston 28. If the quantity of fluid on the piston rod side of the piston remained the same, the force applied to cable 22 would not cause piston rod 24 to extend further from cylinder 30. Proportional flow control valve 32 is therefore provided which will permit hydraulic fluid to flow from the piston rod side of cylinder 30 to a sump in hydraulic pump system 34 through lines 36 and 38 at a rate which is dependent upon the position of a spindle in valve 32. The position of the spindle is determined by an electric signal delivered to valve 32 by position control circuit 40. This control of the rate of removal of the hydraulic fluid provides a constant speed control of the rate at which piston rod 24 can be extended.

At the same time that hydraulic fluid is expelled from one side of piston 28, it is being introduced to cylinder 30 on the other side of piston 28 through lines 42 and 44. This fluid is provided by hydraulic pump system 34 from the sump at a pressure which is determined in a manner to be described below. Linear actuator 26 is therefore controlled to extend and retract at constant speeds to provide isokinetic exercise in both the concentric and eccentric portions of an exercise cycle.

Load cell 46 produces an analog signal which is proportional to the strain on cable 22. This analog electrical signal is provided to control computer 50. Potentiometer 48 monitors the position of the end of piston rod 24 and delivers an analog signal proportional to this position to control computer 50. Both these signals are converted to digital signals before further processing.

The apparatus is preferably set to begin the retraction portion of the cycle when piston rod 24 has been extended to the maximum, or when the user stops or no longer applies force above a small threshold amount. In the embodiment shown, limit switches 52 and 54 provide a signal to the control computer when the piston rod is fully extended and fully retracted.

To initiate retraction, control computer 50 provides a signal to position control circuit 40 to reverse the hydraulic fluid flows so that fluid will flow from the side of the cylinder opposite from the piston rod, and hydraulic pump system will deliver fluid to the side of the cylinder containing the piston rod. The flow from the cylinder is preferably at a slower constant speed rate during retraction than it is during extension. The pressure supplied by hydraulic pump system 34 is set high enough so that the net force on piston 28 will cause it to retract piston rod 24.

It is desirable, as pointed out above, to provide to the user a measurement of his performance so as to motivate the user to try to improve. Consequently, force display 58 is provided which will be fed signals by control computer 50 representing the performance of the user. It is also desirable that the user be able to program the apparatus to his particular needs, such as the height at which the handle should initially positioned. For this purpose operator input 60 is provided by which the unique identification number of the operator or user may be transmitted to control computer 50.

Turning now to FIG. 3, control computer 50 of FIG. 2 is shown in greater detail. Micro-computer 62 is a single chip such as Motorola MC68705R3 which includes a central processing unit (CPU), program memory in the form of a UV erasable programmable read only memory (EPROM), and a random access memory (RAM). This chip also contains interrupt logic, a counter/timer module, clock circuitry, digital input/output and an analog to digital converter with a four channel multiplexor.

Provided as inputs to micro-computer 62 are the analog signals for load and position from load cell 46 and potentiometer 48 of FIG. 2. Minimum set force potentiometer 64 is provided to set a minimum force which must be exceeded before the proportional control valve will permit fluid to flow from cylinder 30 on the extension portion of the cycles. The software selects these three analog inputs, one at a time, and converts each to a digital representation. The digital load values are used to calculate the force as described above. The calculated force may be displayed on local display 66 which may be a four digit, seven segment light emitting diode display. This display is scanned a digit at a time at a rate sufficiently fast to provide an apparent constant non-flickering presentation.

As indicated with respect to FIG. 2, operator input 60 also provides an input to micro-computer 62. Operator input 60 is a keyboard by which the user can enter his unique identification number. Limit switches 52 and 54 also have their values provided to microcomputer 62. These three signals are all provided as digital inputs which are read and "debounced" to the software algorithm information concerning their states.

Control voltage selector 68 is an analog switch which provides a control voltage to the position control circuit of FIG. 2 derived from the output of one of three potentiometers 70–74. These voltages control the position of the proportional valve and thereby the motion of the piston rod as described above. Potentiometer 70 is a rest adjust which is set to provide no motion of the piston rod. Potentiometer 72 is set to provide a desired extension velocity, and potentiometer 74 is set to provide a desired retraction velocity. The software selects one of these three voltages to be applied to the position control circuit via the digital output of micro-computer 62 depending upon the algoritm currently being executed.

When the exercise stand is used with an incentive display unit, a communication path is set up between micro-computer 62 and the display unit over lines 76 and 78. A master-slave arrangement is used where the incentive display computer is the master. As such, the master issues commands to the slave requesting force and position data, and instructing the micro-computer on direction and rate of travel.

FIG. 4 illustrates a system with multiple exercise stands, each having an incentive display, and all connected to host computer 80. Each stand 82 has its own control computer 84 and its own display computer 86. Host computer 80 maintains records and histories of each user's previous exercise session. When a user begins a session on a particular exercise stand 82, he is asked to identify himself. The display computer 86 then asks host computer 80 for this user's previous session data. Host computer 80 retrieves this data from its mass data storage and down loads it to the requesting display computer. After a session is completed, the results are uploaded to the host computer for storage.

These network systems may contain various types of exercise stands and may be expanded to include a large number of stations. There are many variations to the uses for this type of system. For instance, exercise sessions may be provided by celebrities and used by other users as a comparison. Competitions may be arranged with the contestants in different locations and data transferred via phone lines for comparison. In rehabilitation, the results of all sessions may be retained and used to demonstrate and analyze progress.

Although the system described above utilizes a hydraulic unit which presents advantages as far as cost, it is practical to provide the same operations using an electrical approach. FIG. 5 represents one electrical approach in which cable 22 of FIG. 1 extends from and is retracted by shaft 160 of electric linear actuator 162. Electric linear actuators such as this are commercially available, for example from Raco International, Inc. of Bethel Park, Pa. The apparatus is similar to that of FIG. 2 except position control circuit is connected directly to actuator 162. Force transducer 164 provides a signal to control computer 51 representing the force exerted on shaft 160. Position sensor 166 provides position information to control computer. Limit switches 168 and 170 also are connected to indicate to control computer 51 when the actuator 162 has traveled to its maximum positions. Based on these inputs, control computer 51 provides signals to position control circuit 41 to start, stop and change direction. As with the hydraulic system, linear actuator 162 will cause shaft 160 to move at a constant velocity both on extension and retraction. These velocities may be the same or different in the two directions.

Figure 6:
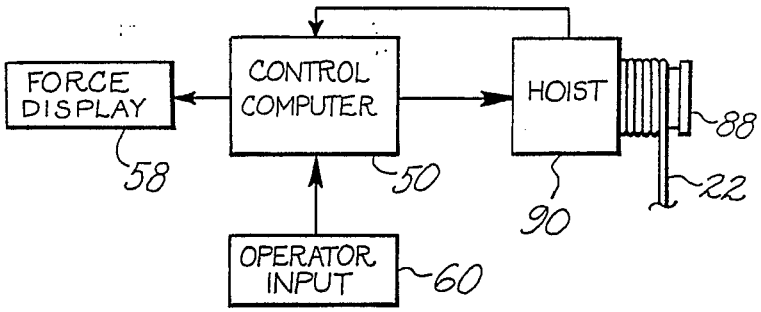
FIG. 6 is another embodiment of a movement control system in accordance with the invention.

Turning next to FIG. 6 another electrical approach is depicted in which cable 22 of FIG. 1 extends from and is retracted on drum 88 of hoist 90. Hoist 90 is controlled by control computer 50 to permit cable 22 to extend at a constant speed when a minimum set force is exerted on cable 22. A signal representing this force is fed to control computer 50 by hoist 90 which initiates this operation. The force applied to cable 22 by the user is opposed by electro-dynamic braking or mechanical braking of hoist 90. The extension of cable 22 is continued for a preset time, and then control computer 50 directs a constant speed retraction until the cable returns to its origin, and another repetition may begin. The operator input 60 and force display 58 operate as previously described.

Figure 7:
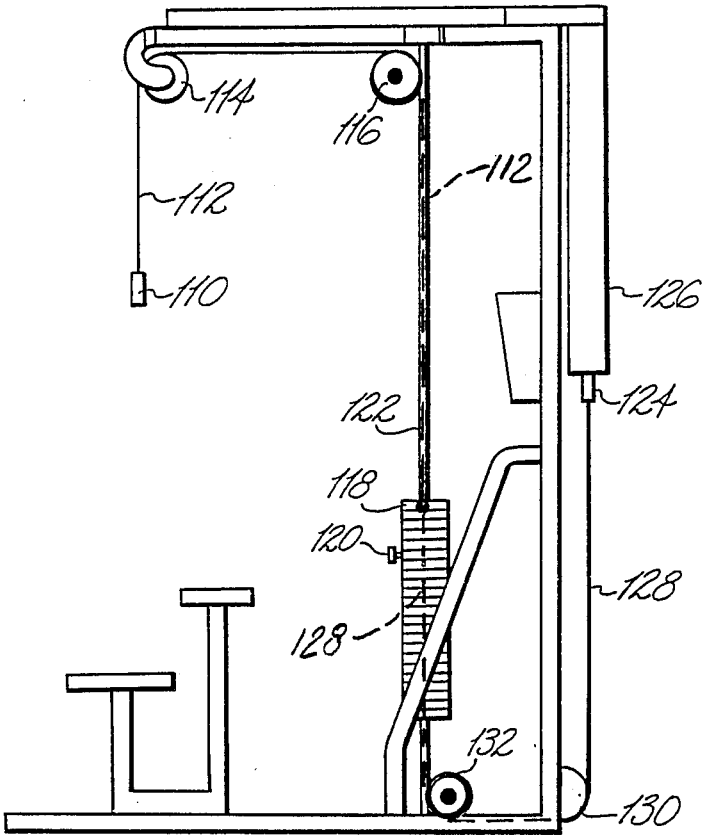
FIG. 7 is a side elevation showing the apparatus of this invention applied to an existing stacked weight machine.

In most cases, it is possible to apply the present invention to existing exercise stands of the stacked weight type by retrofitting the stand as will now be described. Referring to FIG. 7, an overhead pulldown machine is depicted having an exercise handle 110 which is connected to a cable 112. As handle 110 is retracted, cable 112, which is connected through pulleys 114 and 116 to weight 118, will raise weight 118 which is the top weight of a stack of weights. Any number of additional weights from the stack can be connected to weight 118 by passing pin 120 through the hole provided in the bottom weight desired to be added. (This connects the bottom weight to weight 118 through a draw bar not shown in FIG. 1.) Guide rods, such as guide rod 122, confine the stack of weights to limit movement to the vertical direction. This apparatus and the associated framework and seat are conventional, and are exemplary of stacked weight machines.

In accordance with the invention, operating shaft 124 of linear actuator 126, is connected to cable 128 which extends around pulleys 130 and 132 and is connected to top weight 118 through the stack of weights. Linear actuator 126 is rigidly secured to the frame of the apparatus so that it will not move when weight 118 is lifted. The linear actuator restricts movement of weight 118, to an isokinetic rate at which the optimum benefit will occur in the building of muscle strength. At the same time the linear actuator shaft 124 is moving down at a constant speed, the user is pulling with maximum strength on handles 110. The linear actuator is designed to resist loads beyond those which can be exerted by the user, such as one thousand pounds. This prevents the user from exceeding the set rate of movement. At the completion of the positive contraction—when the lower limit of the travel of shaft 124 is reached, a limit switch closes which causes linear actuator 126 to retract shaft 124 and cable 128—again at a fixed rate which has been set. The user resists this movement with maximum strength, but the handles are inexorably drawn upwardly. If the user moves handles 110 at the same velocity at which shaft 124 is moving, the force applied by the user will be the same as if the linear actuator were not used. If the user attempts to retard the movement of the handles, the force applied will be greater than that required to move the weights at the rate of shaft 124. This means that the user can exert the higher force which he is capable of exerting in the negative resistance mode—something which is not possible without the linear actuator attachment.

Although an overhead pull down machine is shown in FIG. 1, it will be evident that suitable placement of the linear actuator and the associated cable and pulley system, will permit the apparatus to be used with any stacked weight type exercise machine. It is important that the force exerted by linear actuator 126 be applied in line with and in the direction of travel of weight 118 because any eccentrically applied force will tend to bind the weights or otherwise detract from smooth operation of the machine.

Figure 8:
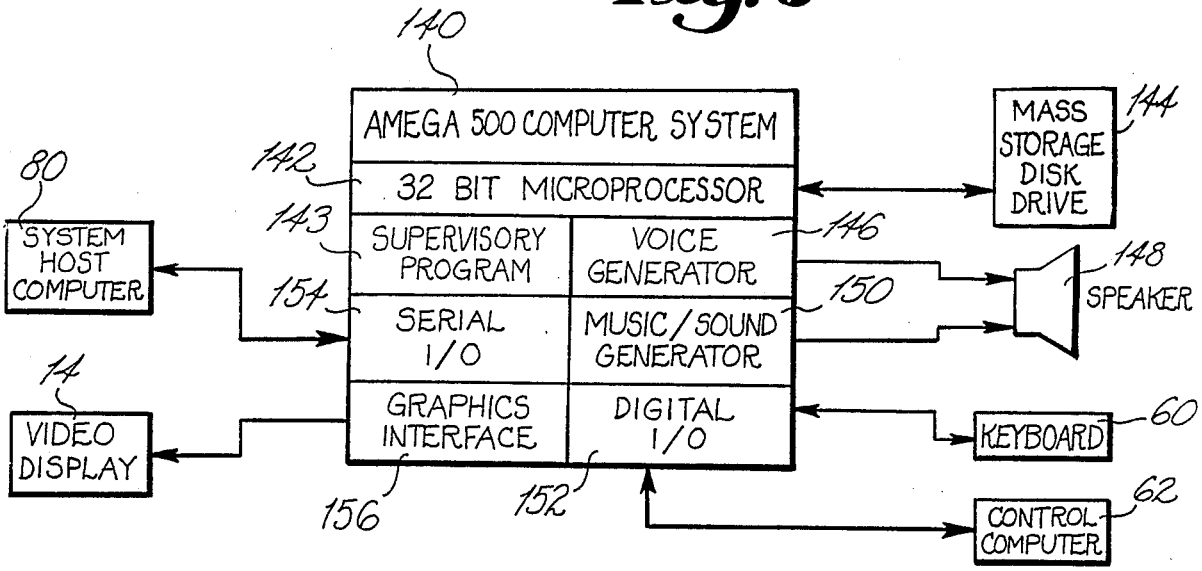
FIG. 8 is a block diagram showing the display computer of FIG. 4.

Referring now to FIG. 8, a more detailed description of the display computer will be given. It should be recognized that the systems described with respect to FIGS. 1–3 and 5–7 will operate without the display computer, the display computer is a motivational device to spur the user to try to improve his performance. It does this primarily by displaying at each exercise stand the user's performance of each repetition as it was during the user's previous exercise session at this stand. On the same display, the user's present performance on each repetition is shown. So the user sees in front of him a first vertical bar representing the force exerted during the first repetition of the previous performance, and a parallel bar which is drawn as he performs showing the current force exerted. Similar pairs of bars are portrayed for all repetitions.

The importance of motivation should not be minimized. Racers typically give their best performances when challenged by strong competition. A person at an exercise stand tries harder when encouraged by a colleague or instructor. The comparison afforded by the present display is against a performance by one at the same level of ability—the user—a few days previously.

An AMEGA 500 computer system 140 incorporates a Motorola 68000 family computer 142. This computer is a powerful 32 bit microprocessor which provides the necessary functions. It directly addresses large amounts of memory, which are needed to provide realistic high resolution graphic video displays. It also provides for a multitasking environment which is necessary to communicate with other computers while simultaneously providing display, voice and music outputs. Supervisory program 143 controls the order of processing and communication of the subsystems described below.

Mass storage for program and local data is provided by disk drive 144. This arrangement permits changing the graphic information from time to time to provide a variety of incentive displays to maintain interest in the machine.

Computer system 140 provides male and female voice generator 146. This generator provide operator incentive and prompting through speaker 148. The computer system is also capable of producing high quality synthesized as well as digitized sound and music using music/sound generator 150. These functions are included in the AMEGA system.

The user enters data including his ID number, set-up rates, display type (graph or game) using keyboard 60 which was previously referred to in reference to FIGS. 2, 3, 5 and 6. Computer system 140 scans keyboard 60 using digital input/output port 152. Interface with the exercise stand control computer 62 is also accomplished through digital I/O port 152. Computer system 140 presents command data including requests for data and motion control commands on an eight bit parallel control bus an transfers data on an eight bit data bus.

Serial I/O port 154 is used to communicate with a system host computer, such as system host computer 80 of FIG. 4. Computer system 140 requests previously stored performance data from host computer 80 by transmitting a request code sequence which includes the exercise stand number and the user ID. Host computer 80 responds with the appropriate information from its mass storage. When an exercise session has been completed, the display computer sends the results of the current session to the host computer.

Information is displayed for the user on video display 14 which is driven by computer system 140 using graphics interface 156. The display is a color display monitor having 640×640 pixel capability which is used to provide high resolution graphic presentations. Graphic images may be produced by the digitization of actual video images which are later animated to produce the desired effects. Custom graphic images may also be provided.

Other computer systems are available which will provide similar capabilities.

Figure 9:
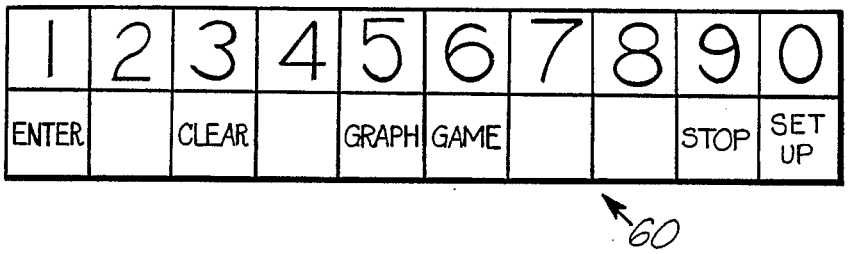
FIG. 9 represents diagrammatically a keyboard for data entry.

Referring to FIG. 9, operator input 60 of FIGS. 2, 3, 5 and 6, is shown as having two rows of keys. The upper row is a set of numeral keys, while the lower row includes keys for the functions indicated on their faces. With this keyboard, the user enters his user identification number and selects a graph or game display. If he is a new user, the "set up" key is used which provides appropriate instructions on the display.

Figure 10:
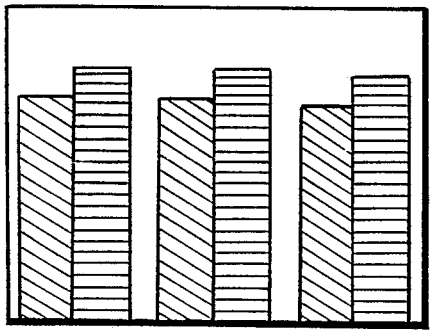
FIG. 10 represents one form of display before exercise begins.

FIG. 10 represents the display of repetition graphs of the first three repetitions of the user on the previous occasion when he exercised on this machine. The height of the green bar represents the average force applied during the extension portion (concentric exercise) of the repetitions and the height of the blue bar represents the average force applied during the retraction portion (compulsive eccentric exercise) of the repetitions. It should be understood that the force exerted during an extension or retraction is not a constant over the duration of the extension or retraction.

Figure 11:
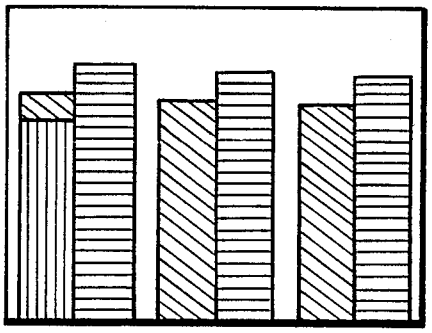
FIG. 11 represents one form of display during exercise.

FIG. 11 represents the display during the time when the user is performing the first extension of the current exercise session on the machine. As shown, a red bar partially obscures the green bar. The top of the red bar represents the instantaneous force being exerted by the user. The top of the green bar represents the instantaneous force exerted by the user on the previous occasion at the same particular point in the extension. (This could be based on the linear length of the extension or, since the rate is constant, the particular point in time of the extension.) The instantaneous forces are measured at a sampling rate such as thirty samples per second. As depicted, the user is currently exerting less force than at the previous occasion. If the user was exceeding the instantaneous force on the previous occasion, a horizontal line would be drawn through the red bar at the level of the previous occasion force. At the end of the extension portion of the repetition, or when the force exerted by the user fails to exceed a preset minimum force, the retraction portion begins. The user attempts to keep the red bar at a higher level than the blue bar throughout this portion of the cycle also. As each repetition is completed, the bars representing that repetition move off the display to the left and the next in the series of previous repetitions moves onto the display.

The bar type display illustrated in FIGS. 10 and 11 is only one way to present a comparison between previous and present performance. A game type format may also be used which displays two people running or two cars racing. One of the pair is represented moving at a velocity representing the previous work out, and the other is shown moving at a velocity representing the present performance.

With previous machines of the stacked weight type, the user is urged to set the weight at an amount no greater than he move for at least eight complete repetitions. This factor prevents the user from using his maximum effort during the beginning repetitions, when he could apply greater force. With the present invention, on the other hand, the maximum force of which the user is capable can be used on each repetition. This maximum force will diminish somewhat with each successive repetition as the user fatigues down to a base fatigue level. Base fatigue is the point at which a muscle can continue to reproduce a level of exertion; for example, an exerciser may be able to exert 100 pounds of force at the beginning of an exercise, but when he has fatigued to the base level he may only be able to exert 20 pounds of force. At this 20 pound base fatigue level he is able to continue to perform exercise repetitions.

When the user has completed his exercise session at the machine, he presses the stop key. The display then shows a summary giving the results of the session, for example as a percentage improvement. The measured force data samples for each repetition are then sent to memory for storage until the user returns for his next exercise session on the machines.

The bar type display may be of more importance and utility to a user who is exercising to improve strength than to a user more interested in maintaining strength and flexibility. Consequently, other types of displays, such as games, may be optionally provided to help in preventing boredom. Moreover, the male and female voice generators and music/sound generators provide the capability of audio encouragement and energetic rhythms to accompany the exercise.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

I claim:

1. In an exercise apparatus having a linearly extendable and retractable flexible tension transmitting device having a first end to which force may be applied by a user and a second end, a movement control system for connection to the second end of the flexible tension transmitting device comprising:

control means including a power driven linear actuator operably connected to the second end of the flexible tension transmitting device;

said control means regulating the extension of the second end of the flexible tension transmitting device to a first constant velocity;

said control means regulating the retraction of the second end of the flexible tension transmitting device to a second constant velocity; and force measuring equipment operably connected to said control means to measure the force applied to the flexible tension transmitting device.

2. A movement control system in accordance with claim 1 wherein said control means further includes:

a control computer connected to receive measured force signals provided by said force measuring equipment and producing control signals in response thereto.

3. A movement control system in accordance with claim 2 further including:

an operator input connected to provide user information to said control computer.

4. A movement control system in accordance with claim 2 further including:

a display connected to said control computer to display user force applied to said flexible tension transmitting device.

5. A movement control system in accordance with claim 4 wherein:

said display is an audiovisual display;

said control system further includes a display computer operably connected to drive said audiovisual display and a host computer connected to said display computer;

said display computer is connected to received and store signals of real time force measurements from said control computer representing current exercise performance of a user;

said display computer is connected to receive signals of force measurements representing previous exercise performance of said user from said host computer;

said audiovisual display displays simultaneously images representing said current exercise performance and said previous exercise performance, whereby said audiovisual display provides incentive; and said display computer is connected to send said signals of force measurements representing current exercise performance of said user to said host computer for storing.

6. A movement control system in accordance with claim 1 wherein:

said linear actuator is a hydraulic linear actuator having a hydraulic cylinder containing a piston mounted for axial movement within said hydraulic cylinder, a piston rod connected to said piston having an operating end extending from said hydraulic cylinder, and a hydraulic pump system for providing hydraulic fluids to said hydraulic cylinder; said operating end of said piston rod being connected to said flexible tension transmitting device.

7. A movement control system in accordance with claim 6 wherein: said control means includes a valve operably connected to limit flow of hydraulic fluid from said hydraulic cylinder to a predetermined flow rate.

8. A movement control system in accordance with claim 7 wherein:

said control means includes a control computer;

said valve is a proportional flow control valve having a spool positionable by an electrical signal; and a position control circuit provides said electrical signal for positioning said spool in response to a control signal from said control computer.

9. A movement control system in accordance with claim 1 wherein:

said linear actuator is an electrical linear actuator.

10. Exercise apparatus comprising:

a supporting structure;

a flexible tension transmitting device supported by said supporting structure;

said flexible tension transmitting device being linearly extendable and retractable;

a user force application device operatively connected to said flexible tension transmitting device for transmitting user force tending to extend said tension transmitting device;

a linear actuator including a hydraulic cylinder having a piston slideably supported therein dividing said cylinder into first and second variable volume chambers;

a piston rod having one end connected to said piston and the other end operatively connected to said flexible tension transmitting device;

a first hydraulic fluid line connected to said first variable volume chamber and a second hydraulic fluid line connected to said second variable volume chamber;

a proportional flow control valve connectable to control the flow rate through said first hydraulic fluid line when hydraulic fluid is being expelled from said variable volume chamber, and through said second hydraulic fluid line when hydraulic fluid is being expelled from said second variable volume chamber;

a pump supplying said hydraulic fluid through said second hydraulic fluid line to said second variable volume chamber when said hydraulic fluid is being expelled from said first variable volume chamber, and through said first hydraulic fluid line to said first variable volume chamber when said hydraulic fluid is being expelled from said second variable volume chamber;

a load cell positioned to measure said user force applied to said user force application device and producing signals representative of said user force applied;

a computer connected to said load cell to receive said signals and to produce display control signals representing the instantaneous force being applied at said user force application device;

a display connected to said computer to receive said display control signals and to display a corresponding force image.

11. Exercise apparatus for providing isokinetic concentric and eccentric exercise comprising:

a supporting structure;

control means including a power driven linear actuator having an extendable and retractable shaft mounted on said supporting structure;

a flexible tension transmitting device having one end connected to said shaft and the other end connected to user force application device;

said user force application device having an initial position and an extended position constituting an origin;

said control means limiting movement by a user of said user force application device from said initial position only at a first fixed velocity through at least a portion of the distance to said extended position;

said control means driving said user force application device through said flexible tension transmitting device back to said initial position at a second fixed velocity by exerting a force in excess of a resisting force applied by the user.

12. Exercise apparatus in accordance with claim 11 wherein:

said linear actuator is an electrical linear actuator.

13. Exercise apparatus in accordance with claim 11 wherein:

said linear actuator is a hydraulic linear actuator.

14. Exercise apparatus in accordance with claim 11 further including:

transducers connected to said linear actuator for producing signals representing said user force exerted on said user application device and the position of said user force application device relative to said origin.

15. Exercise apparatus in accordance with claim 14 further including:

a control computer connected to said transducers to receive said signals produced by said transducers and produce performance signals representing the performance of the user;

a memory in said control computer for storing said performance signals.

16. Exercise apparatus in accordance with claim 15 further including:

a video display connected to said control computer and secured to said supporting structure for displaying a performance comparison of the user's present performance with the user's previous performance.

17. Exercise apparatus in accordance with claim 16 further including:

sound generating apparatus connected to said control computer for producing audio signals pertaining to the user's performance.

18. A method of inducing preferred user exercising techniques with apparatus having a reciprocatable flexible tension transmitting device having a first end and a second end with a user force application device connected to the first end comprising the steps of:

(1) connecting the second end of the reciprocatable flexible tension transmitting device to a linear actuator;

(2) restricting extension of said reciprocatable flexible tension transmitting device to a first constant velocity;

(3) retracting said reciprocatable flexible tension transmitting device at a second constant velocity;

(4) simultaneously with steps 2 and 3, displaying to a user a first image representing force presently being exerted by the user on the user force application device, and a second image representing force exerted by the user on the user force application device on a previous occasion.

* * * * *

UNITED STATES PATENT AND TRADEMARK OFFICE

CERTIFICATE OF CORRECTION

PATENT NO. : 4,919,418

DATED : April 24, 1990

INVENTOR(S) : Jan W. Miller

It is certified that error appears in the above-identified patent and that said Letters Patent is hereby corrected as shown below:

In the claims:

Claim 10, column 13, line 6, after "said" insert --first--.

Signed and Sealed this

Twenty-fifth Day of June, 1991

*Attest:*

*Attesting Officer*

HARRY F. MANBECK, JR.

*Commissioner of Patents and Trademarks*